United States Patent [19]

Menge et al.

[11] 4,059,940

[45] Nov. 29, 1977

[54] APPARATUS FOR FILLING CONTAINERS WITH CIGARETTES OR THE LIKE

[75] Inventors: Günter Menge; Karl-Heinz Grieben; Lutz Reitmeier, all of Hamburg; Willi Frank, Hohnsdorf, all of Germany

[73] Assignee: Hauni-Werke Korber & Co. KG, Hamburg, Germany

[21] Appl. No.: 671,744

[22] Filed: Mar. 30, 1976

[30] Foreign Application Priority Data

Apr. 11, 1975 Germany ..... 2515898

[51] Int. Cl.[2] ..... B65B 19/04

[52] U.S. Cl. ..... 53/148; 53/162

[58] Field of Search ..... 53/148, 159, 150, 236, 53/160, 162; 198/20 C; 214/1 BV, 6 FS

[56] References Cited

U.S. PATENT DOCUMENTS

| | | | |
|---|---|---|---|
| 1,964,084 | 6/1934 | Rundell | 53/150 X |
| 3,190,459 | 6/1965 | Kochalski et al. | 198/20 C |
| 3,196,594 | 7/1965 | Focke et al. | 53/148 X |
| 3,308,600 | 3/1967 | Erdmann et al. | 53/148 X |
| 3,599,396 | 8/1971 | Schmezmund | 214/6 FS |
| 3,948,115 | 4/1976 | Seragnoli | 53/148 X |
| 3,967,740 | 7/1976 | Molins | 53/148 X |

*Primary Examiner*—Othell M. Simpson
*Assistant Examiner*—John Sipos
*Attorney, Agent, or Firm*—Peter K. Kontler

[57] ABSTRACT

A tray filling apparatus wherein a suction head accumulates rows of cigarettes and a pusher transfers the rows into a tray which is supported by an endless chain conveyor. The suction head and the pusher receive motion from a drive which includes a variable-speed DC-motor, a step-down gearing which is driven by the output shaft of the motor, and a mechanical transmission having a first component which moves the suction head between a lower position in which the latter accumulates a row of cigarettes and one of two raised positions, and a second component which moves the pusher forwardly not later than when the suction head reaches a raised position. The forward movement of the pusher is slower than its return movement to retracted position and the characteristic RPM curve of the motor is determined by a control circuit which includes three signal generators one of which starts the motor, another of which decelerates the motor after the suction head returns to lower position and the pusher reassumes its retracted position, and the third of which arrests the motor while the suction head and the pusher respectively dwell in their lower and retracted positions. A second electric motor drives the conveyor for an empty or partly filled tray through the medium of a second transmission in stepwise fashion upon completion of each forward stroke of the pusher.

19 Claims, 7 Drawing Figures

1
2
2A
3
4
6
7
8
9
11
12
13
14
16
17
19
21
22
23
24
26
F 19
95
96
97
98
99
100
91
89
88
87
86
92
93
94
6
a
b
19a
13a
27a
76a
74a
71a
t
d
RPM

APPARATUS FOR FILLING CONTAINERS WITH CIGARETTES OR THE LIKE

BACKGROUND OF THE INVENTION

The present invention relates to apparatus for introducing groups of rod-shaped smokers' products or the like into containers, especially for introducing rows or layers of plain or filter-tipped cigarettes, cigarillos or cigars into containers of the type known as chargers or trays. More particularly, the invention relates to improvements in apparatus for introducing groups of rod-shaped articles (hereinafter called cigarettes for short) into containers (hereinafter called trays for short) in such a way that the cigarettes move axially and accumulate into stacks which can be fed into the magazines of packing machines or the like.

In many tobacco processing plants, the output of each cigarette making machine is introduced into trays and the thus filled trays are thereupon transported to packing machines, to storage or to other processing stations. As a rule, a tray filling apparatus comprises one or more endless belt or chain conveyors which transport a row of cigarettes sideways from the maker (e.g., from a machine for the production of plain or filter-tipped cigarettes) to a tray filling station, a suction head or an analogous group forming device which accepts or removes cigarettes from the endless conveyors and assembles the cigarettes into groups each of which contains a predetermined number of cigarettes in a predetermined array (e.g., an elongated row or layer of 50–100 cigarettes, depending on the diameters of cigarettes and/or the size of the tray), a pusher or analogous transfer means for moving successive groups from the group forming device into an adjacent empty or partially filled tray (such tray is preferably carried by a chain conveyor or an analogous transporting device which can move the tray stepwise along the tray filling station), and a drive for the transfer means.

The drive for the transfer means of all or nearly all presently known tray filling apparatus comprises a fluid-operated assembly, preferably a pneumatic cylinder and piston unit whose cylinder or piston reciprocates the transfer means between retracted and extended positions whereby the transfer means pushes a group of cigarettes from the group forming device into the adjacent empty or partially filled tray during movement from the retracted position. Pneumatic cylinder and piston units are simple, rugged and reliable, and the movements of their parts can be regulated with a high degree of reproducibility. However, the output of tray filling apparatus wherein the transfer means receives motion from a fluid-operated cylinder and piston unit cannot be increased at will. It has been found that the maximum output is in the range of approximately 70 cycles per minute. Such limitations are attributable to several factors. Thus, the speed of translatory movement of a pneumatically operated piston or cylinder (depending upon whether the transfer means is coupled to the piston or to the cylinder) cannot exceed a predetermined value due to inertia of valves and/or other elements which regulate the admission and evacuation of fluid from the cylinder chamber or chambers. Furthermore, once the speed of the cylinder or piston has risen to a given value, the noise level and/or stray movements (especially vibration) of parts which are associated with the fluid-operated unit exceed the permissible norms. For example, if the cylinder is of the double-acting type, alternating admission and evacuation of pressurized fluid from the two cylinder chambers is followed by impingement of the movable part (normally piston) against a suitably positioned stop which limits the extent of forward or rearward movement of the piston. Such impingement causes the aforementioned vibration and noise. Moreover, the output of tray filling apparatus utilizing one or more pneumatic cylinder and piston units can be increased only by reducing the duration of return stroke of the piston since the maximum speed or forward strokes is limited by the delicate nature of articles which are being transferred into trays. Thus, if the transfer means (e.g., an elongated pusher plate) is permitted to strike against the trailing ends of a row of cigarettes at a very high speed, the trailing ends are likely to be deformed or damaged. Limits to acceleration of the return stroke of a reciprocable piston are imposed by the fact that excessive speed entails unacceptable increase in noise level and vibration of the moving parts.

Consequently, if the output of tray filling apparatus is to be increased above 70 cycles per minute, the fluid-operated drive must be replaced with another drive.

SUMMARY OF THE INVENTION

An object of the invention is to provide novel and improved drives for use in apparatus wherein cigarettes or analogous rod-shaped articles are introduced into trays or analogous containers.

Another object of the invention is to provide a novel and improved drive for the pushers or analogous means which are used to transfer groups of cigarettes or the like into chargers, trays or analogous containers.

A further object of the invention is to provide a novel and improved drive for the conveyor or conveyors which transport trays in apparatus wherein such trays are filled with cigarettes or the like prior to transport into storage, to a packing machine or to another destination.

An additional object of the invention is to provide the tray filling apparatus with one or more novel and improved drives which enable the apparatus to increase their output without damaging or defacing the articles, which are relatively simple and inexpensive, which are superior to heretofore known drives using fluid-operated cylinder and piston units, and which can be installed in existing apparatus with a minimum of cost for alterations.

The invention is embodied in an apparatus for introducing groups (e.g., layers or rows) of cigarettes or analogous rod-shaped articles into chargers, trays or analogous containers. The apparatus comprises an elongated suction head or an analogous group forming device, one or more belt conveyors or other suitable means for supplying articles to the group forming device, a chain conveyor or analogous means for transporting containers past the group forming device, a reciprocable pusher or analogous transfer means for moving groups of articles from the group forming device into a container on the conveyor means, means for confining the transfer means to translatory movements between first and second positions whereby the transfer means moves a group of articles from the group forming device into a container on the conveyor means during movement from the first position thereof, and drive means for moving the transfer means between first and second positions.

In accordance with a feature of the invention, the drive means comprises a variable-speed prime mover (e.g., a variable-speed DC-motor) having a rotary output element which rotates in a single direction (such output element may be the output shaft of the motor or the output element of a step-down gearing), a mechanical transmission (e.g., a linkage) having input means (such as a camshaft) receiving motion from the output element of the prime mover and output means (e.g., a link) for imparting translatory movements to the transfer means, and control means for varying the RPM of the output element of the prime mover in accordance with a predetermined pattern.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
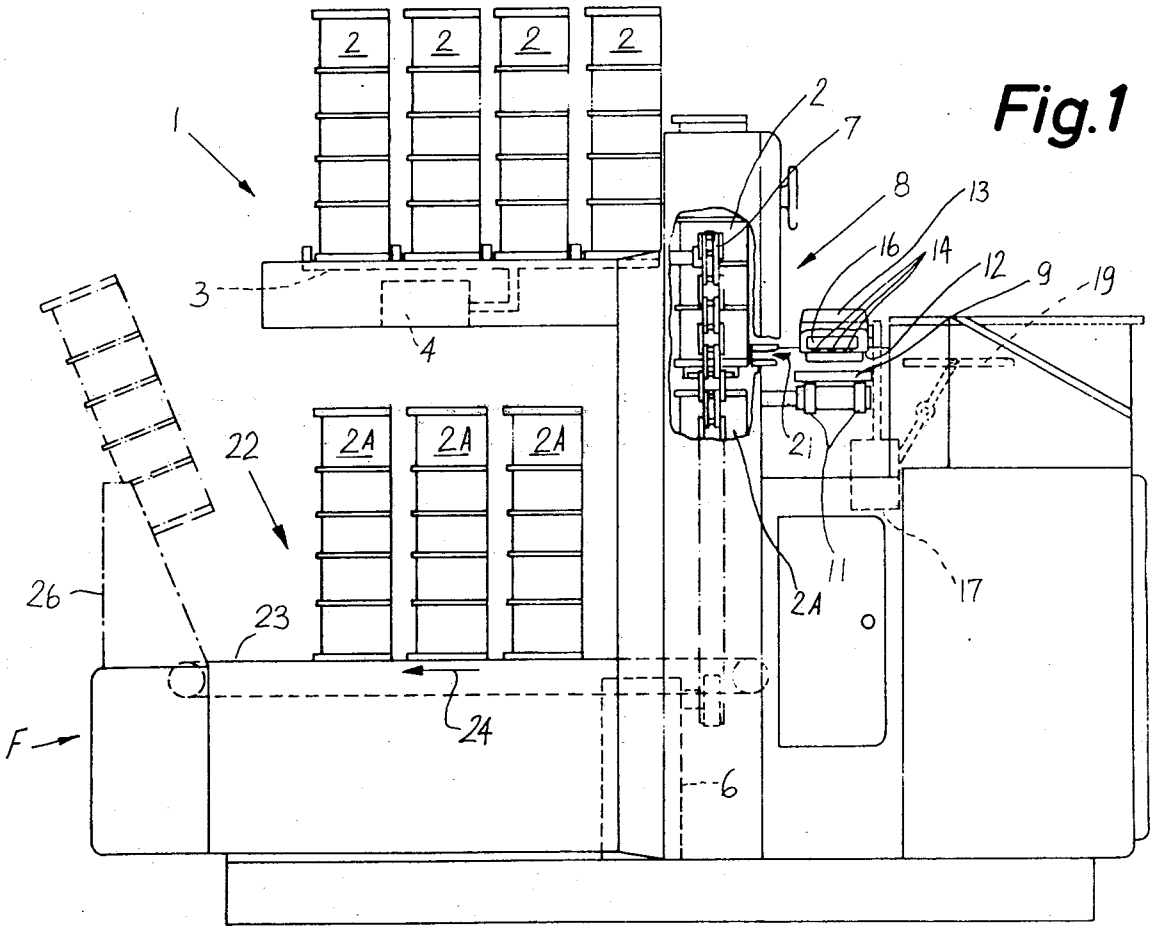
FIG. 1 is a schematic partly elevational and partly sectional view of a tray filling apparatus having drives which embody the invention.

FIG. 1 shows a tray filling apparatus which is similar to an apparatus known as CASCADE (trademark) produced and sold by Hauni-Werke Korber & Co. KG, of Hamburg-Bergedorf, Federal Republic Germany. The frame F of the tray filling apparatus has a horizontal platform 1 which defines a first station for storage of a series of empty containers or trays 2. The platform 1 supports a combined lifting and advancing mechanism 3 which receives motion from a drive 4 and serves to move (when necessary) the foremost empty tray 2 into the range of a chain conveyor 7 which is operated stepwise by a drive 6. The endless link chain of the conveyor 7 moves the foremost empty tray 2 stepwise in a downward direction past a filling station 8 where the tray receives groups (preferably rows or layers) of rod-shaped articles 9 (e.g., filter cigarettes) so that it accumulates a stack of such articles not later than when it reaches the lower end of the vertical path defined by the conveyor 7. The articles 9 are supplied to the filling station 8 by the upper reaches of two endless band conveyors 11 which extend at right angles to the plane of FIG. 1 and move the articles into the range of an elongated group forming device here shown as a suction head or lifter 13. The underside of the suction head 13 has a row of parallel flutes or sockets 12 for discrete articles 9, and such sockets are connectable to a suction generating device so that the suction head can lift the articles off the band conveyors 11 to form an elongated row of parallel articles which are thereupon transferred into the adjacent tray 2 on the conveyor 7. The sockets 12 at the underside of the suction head 13 are closely adjacent to the upper reaches of the band conveyors 11 and the number of such sockets is selected with a view to insure the formation of rows each of which contains a predetermined number of parallel articles without any gaps therebetween. The suction generating device includes a suction chamber 16 in the interior of the suction head 13 and channels or passages 14 which connect the chamber 16 with the sockets 12.

When the suction head 13 accumulates a complete group or row of articles 9, it is raised slightly above its article-collecting lower end position by a drive 17, and the latter also causes a reciprocable pusher or transfer means 19 to perform a forward stroke in order to transfer the freshly formed row of articles 9 into the adjacent tray 2. The articles 9 of such row are caused to pass through an elongated mouthpiece or nozzle 21 which is disposed between the suction head 13 and the tray 2 on the conveyor 7. The drive 6 thereupon causes the conveyor 7 (and the partially filled tray 2 thereon) to descend through a distance which is slightly less than the diameter of an article 9 while the drive 17 moves the pusher 19 back to the retracted position and causes the suction head 13 to descend back to its lower end position in which the sockets 12 are sufficiently close to the upper reaches of the band conveyors 11 to be in an optimum position for accumulation of a fresh row to articles 9. The same series of operations is repeated again and again so that the tray 2 on the conveyor 7 accumulates a stack consisting of a predetermined number of rows or layers of parallel articles 9.

When the conveyor 7 completes a predetermined number of steps (i.e., when the tray 2 thereon collects a predetermined number of layers or rows of articles 9), the drive 4 causes the mechanism 3 to place the next empty tray 2 into the range of the conveyor 7. At such time, the freshly filled tray 2A has descended to the level of a station 22 which accommodates filled trays. Such filled tray 2A is then in a position to be engaged and entrained (arrow 24) by a further conveyor 23. If the apparatus of FIG. 1 does not embody any means for automatically transferring filled trays 2A to the next processing station, the station 22 may include a suitably inclined elevator 26 which can engage and raise the foremost filled tray 2A so that the tray is in an optimum position for removal from the frame F. The elevator 26 is indicated by phantom lines because it is optional. If used, the elevator is installed at the discharge end of the conveyor 23.

The invention is embodied in the drives 6 and 17. In presently known tray filling apparatus, the drives for the tray transporting conveyor and the pusher include fluid-operated (pneumatic) cylinder and piston units. In accordance with the present invention, the drives 6 and 17 embody prime movers in the form of electric motors which transmit motion to the conveyor 7 and pusher 19 through the medium of transmissions.

Figure 2:
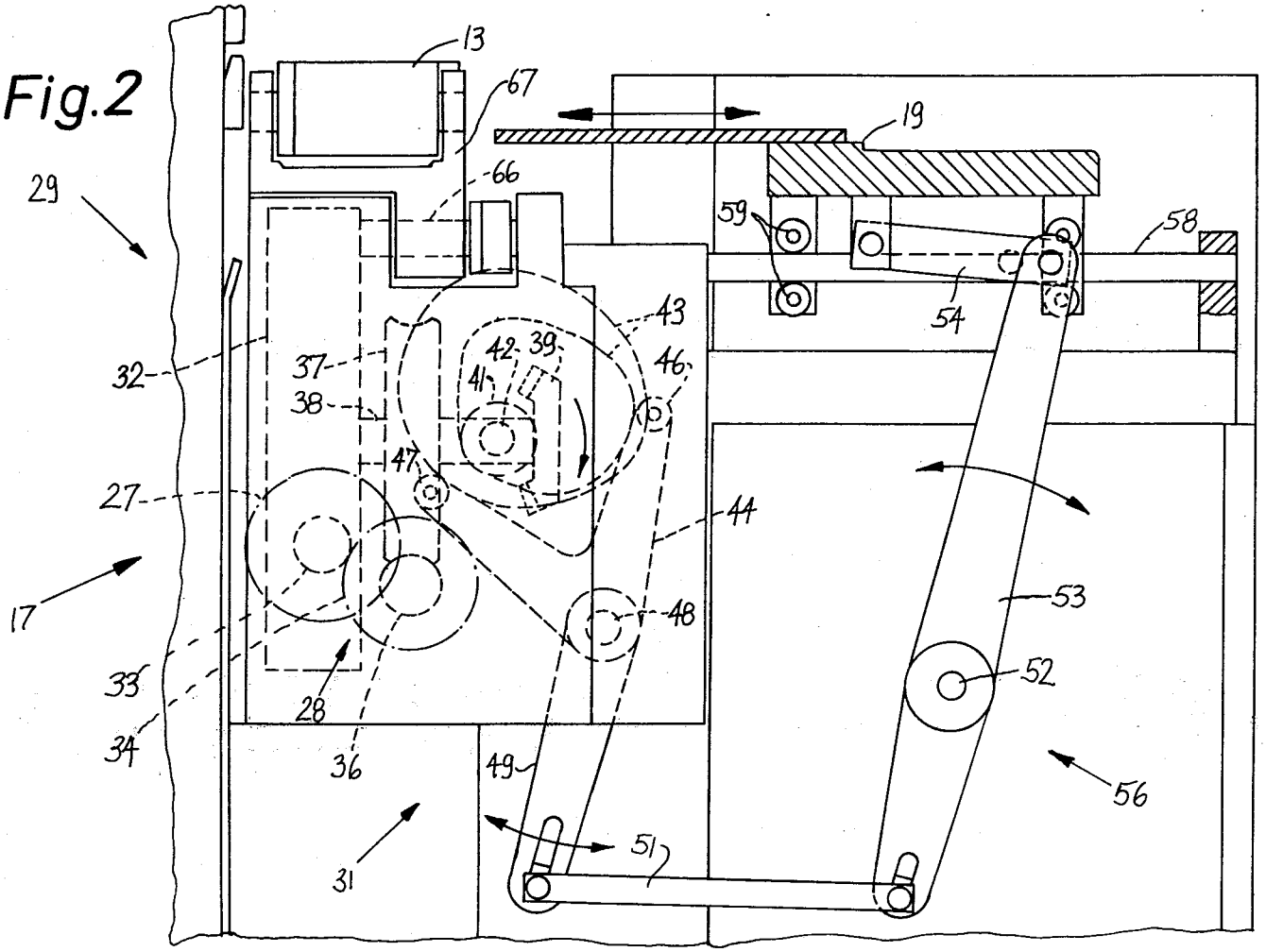
FIG. 2 is an enlarged view of a detail in FIG. 1, showing certain elements of the drive for the transfer means of the tray filling apparatus.
Figure 3:
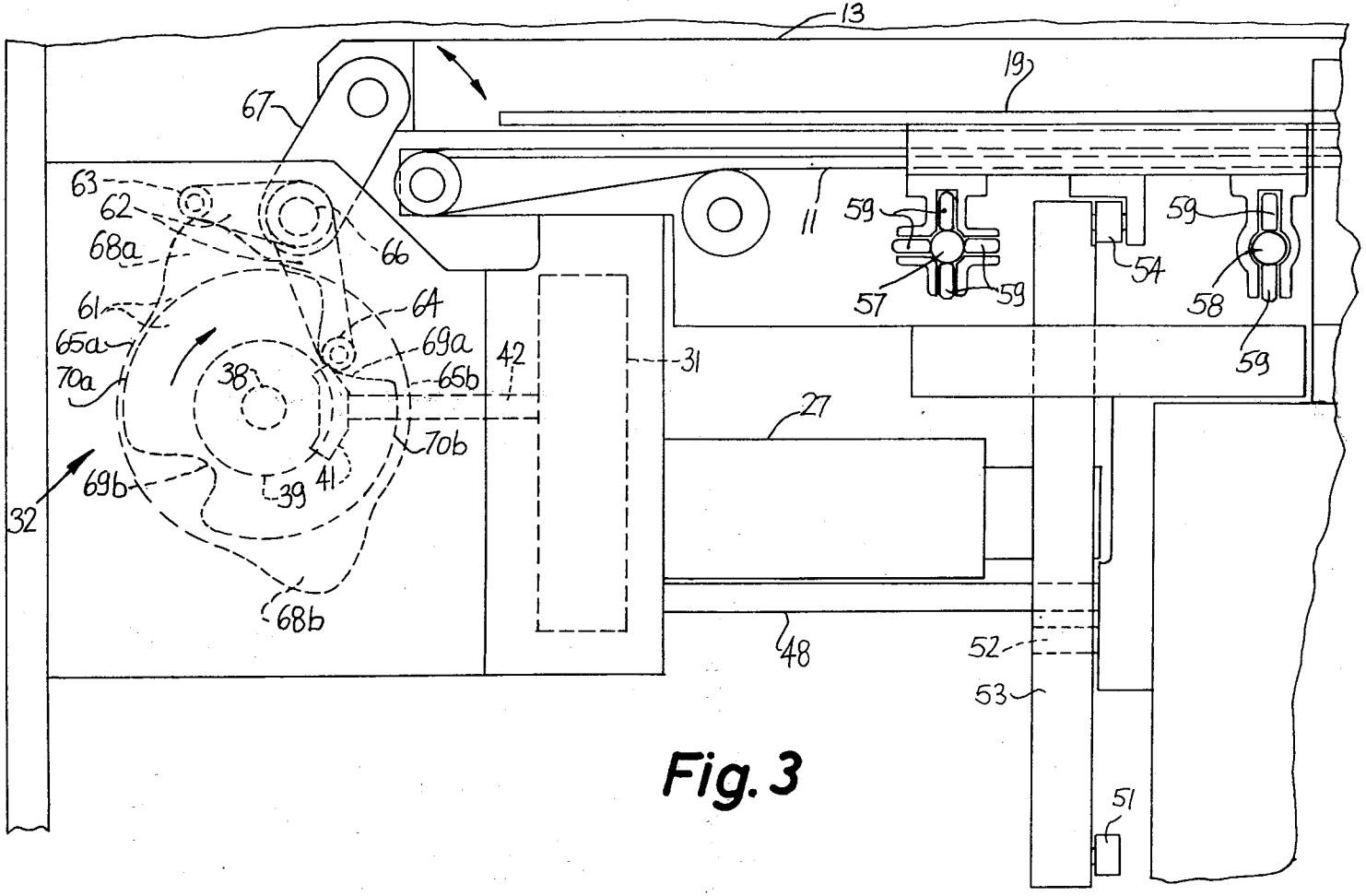
FIG. 3 is a view as seen from the left-hand side of FIG. 2.

The details of the drive 17 as shown in FIGS. 2 and 3. This drive comprises a prime mover here shown as a variable-speed DC-motor 27 whose output element drives a step-down gearing 28 which, in turn, drives the pusher 19 and the suction head 13 through the medium of a mechanical transmission 29. The transmission 29 includes a first component 31 which transmits motion to the pusher 19 and a second component 32 which transmits motion to the suction head 13. The component 31 (shown as a box in FIG. 3) is illustrated in detail in FIG. 2, and the component 32 (shown as a box in FIG. 2) is illustrated in detail in FIG. 3.

The step-down gearing 28 comprises mating spur gears 33, 34 the former of which is driven by the output element of the motor 27, a worm 36 which is driven by the spur gear 34, and a worm wheel 37 which is driven by the worm 36 and rotates a camshaft 38. The shaft 38 forms part of the input element of the mechanical transmission 29; it transmits torque directly to the component 32 and indirectly to the component 31 (by way of a pair of bevel gears 39, 41 having a transmission ratio of two-to-one). The bevel gear 39 is driven by the camshaft 38 and drives the bevel gear 41 which drives a camshaft 42.

The component 31 comprises a first control unit which is composed to two disk-shaped cams 43 affixed to the shaft 42 and cooperating with the roller followers 46, 47 of two pivotable bell crank levers 44. The levers 44 are mounted on a shaft 48 which is rigid with a lever 49 coupled with the shorter arm of a two-armed lever 53 by way of a link 51. The lever 53 is mounted on a shaft 52 and its longer arm serves to transmit motion to the pusher 19 by way of a link 54 which constitutes an output element of the transmission 29. The levers 44, 49, 53 and links 51, 54 together constitute a power or linkage 56. The pusher 19 is confined to translatory (reciprocatory) movement by two parallel tie rods 57, 58 and has rollers 59 which travel along the tie rods.

The component 32 of the mechanical transmission 29 comprises a second control unit composed of two disk-shaped cams 61 which are affixed to the camshaft 38 and cooperate with the roller followers 63, 64 of two levers 62. These levers are pivotable about the axis of a shaft 66 which is rigid with a bifurcated output element 67 articulately connected to one end of the suction head 13. One of the cams 61 has two protuberances or lobes **68*a* 68*b* which are located substantially diametrically opposite each other, and the other cam 61 has two recesses or valleys 69*a*, 69*b* also located diametrically opposite each other. In FIG. 3, the roller followers 63, 64 respectively engage the adjacent lobe 68*a* and the surface bounding the adjacent recess 69*a* whereby the levers 62 hold the suction head 13 in the lower end position in which the sockets 12 are sufficiently close to the upper reaches of the band conveyors 11 to be capable of accumulating a row of articles 9**.

The two major portions **65*a*, 65*b* of the periphery of that cam 61 which is formed with the lobes 68*a*, 68*b* constitute parts of two cylindrical surfaces whose axes coincide with the axis of the shaft 38. Analogously, the two major portions 70*a*, 70*b* of the periphery of the cam 61 having the recesses 69*a*, 69*b* are parts of two cylindrical surfaces which are coaxial with the shaft 38. The radii of curvature of portions 65*b*, 70*a* are respectively larger than those of 65*a*, 70*b*. Consequently, whenever the cams 61 complete a full revolution, the bifurcated output element 67 causes the suction head 13 to move twice in a direction to the left, as viewed in FIG. 3, first to a first level and thereupon to a second level. In each of these positions, the pusher 19 can transfer a row of articles 9 into the adjacent tray 2 on the conveyor 7. The difference between the two levels of the suction head 13 equals or approximates the radius of an article 9**.

The purpose of moving the suction head 13 to two different levels will be readily understood by observing the array of cigarettes in a customary pack. As a rule, a pack containing twenty cigarettes includes two outer layers of seven cigarettes each and a median layer of six cigarettes. The cigarettes of the median layer are staggered with respect to the cigarettes of the outer layers so that the cigarettes constitute a so-called quincunx formation. When moved to a first level above the lower end position (in which latter position the sockets 12 can receive articles 9 from the band conveyors 11), the suction head 13 maintains the freshly accumulated layer in a position such that its articles are staggered with respect to the articles of the uppermost layer in the adjacent tray 2 on the conveyor 7. The pusher 19 then performs a working stroke and is retracted before the suction head 13 returns to the lower end position so that its sockets 12 accumulate a fresh row of articles 9. The output element 67 then moves the suction head 13 to the second level in which the articles in its sockets 12 are staggered with respect to articles forming the uppermost layer in the adjacent tray 2. Thus, by the simple expedient of using the step-down bevel gear transmission 49, 41 and by utilizing two specially configurated cams 61, the component 32 of the transmission 29 enables the suction head 13 to arrange the articles in the adjacent tray 2 in quincunx formation.

Figure 4:
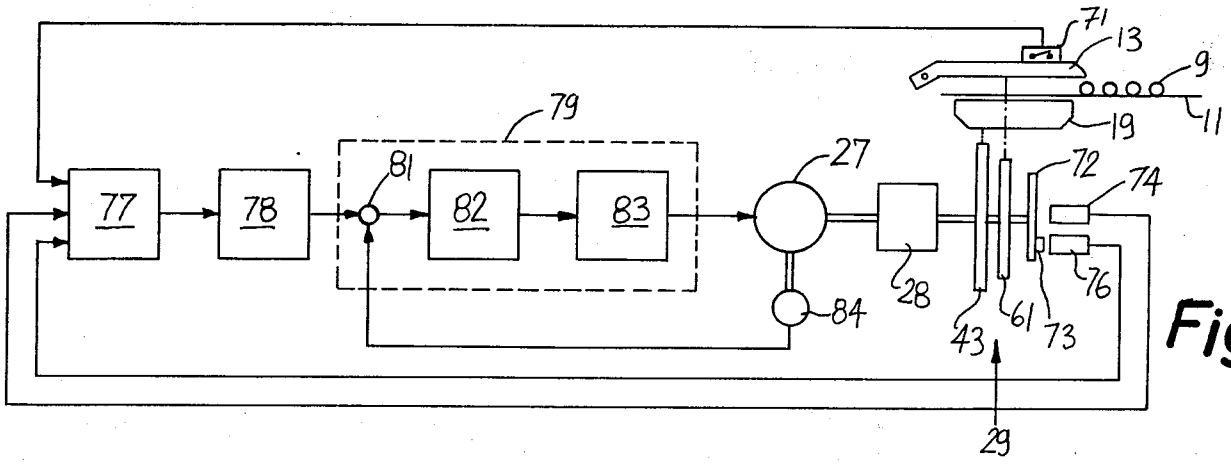
FIG. 4 is a diagram of the control means for the motor of the drive shown in FIGS. 2 and 3.

FIG. 4 shows the control circuit for the DC-motor 27. Furthermore, FIG. 4 shows schematically the step-down gearing 28, the mechanical transmission 29, the suction head 13, the pusher 19, the band conveyors 11, and a row of articles 9 between the pusher and the suction head. The suction head 13 is associated with and can actuate a first signal generator 71 whose signals cause the motor 27 to increase its RPM. For example, the signal generator 71 may constitute a vacuum switch which is actuated in response to entry of an article 9 into the last socket 12 of the suction head 13 (i.e., when the suction head has completed the accumulation of a row or layer of articles 9). The step-down gearing 28 drives a disk-shaped cam 72 having a projection 73; for example, the cam 72 can be fixed to the shaft 42 for the cams 43. The projection 73 of the cam 72 can actuate a second signal generator 74 whose signals are used to reduce the RPM of the motor 27, and a third signal generator 76 whose signals are used to arrest the motor 27.

Figures 5, 6, 7:
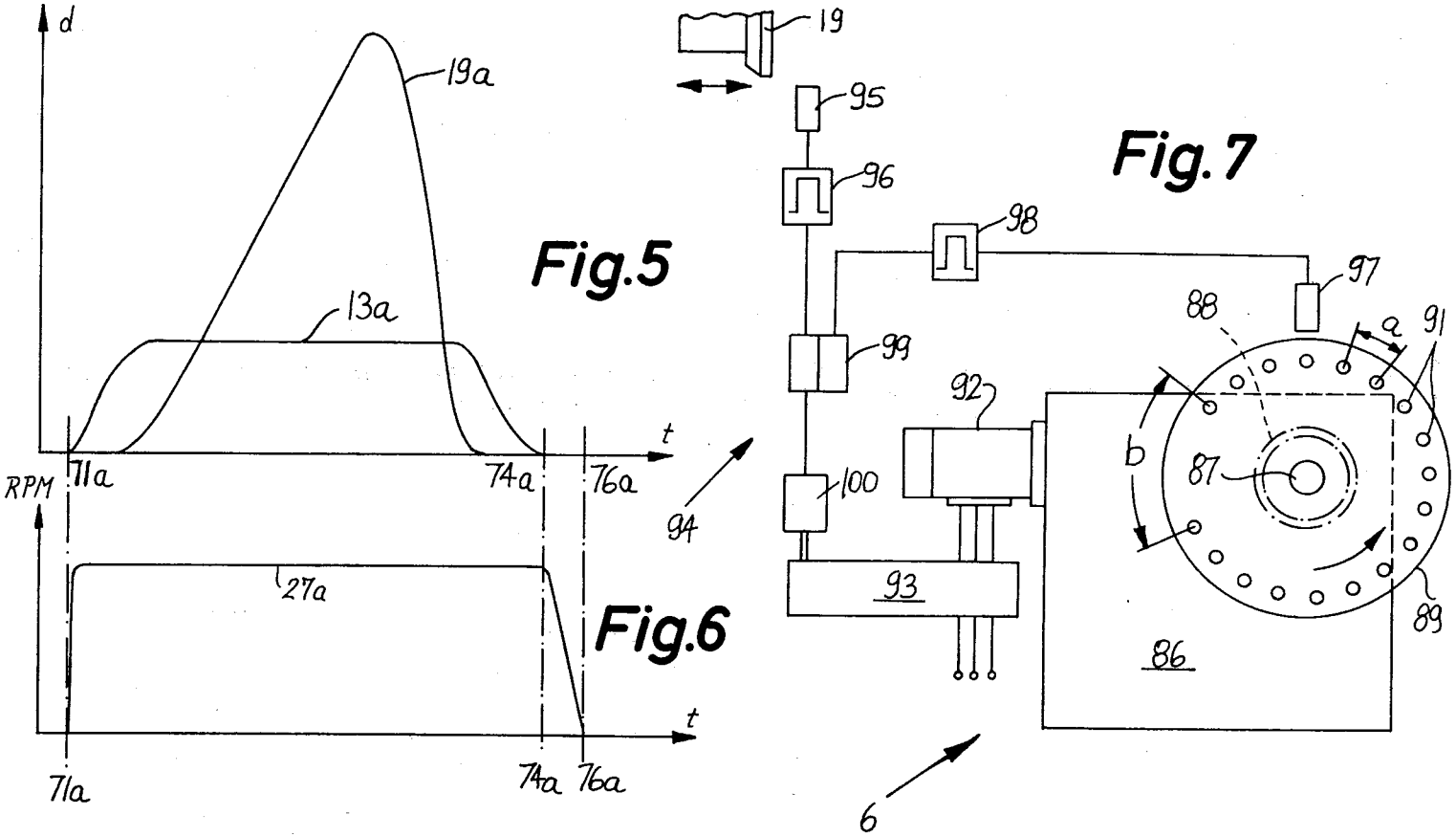
FIG. 5 is a diagram wherein the curves represent the extent and speed of movement of the group forming device and transfer means in the apparatus of FIG. 1.
FIG. 6 is a diagram showing the RPM curve of the motor of the drive of FIGS. 2–3.
FIG. 7 is a diagrammatic view of the drive for the tray transporting conveyor.

The relationship between the cams 43, 61 and the signal generators 74, 76 is shown in the diagram of FIG. 5. Each of the signal generators 74, 76 may constitute a proximity switch which transmits a signal when approached by the projection 73 of the cam 72. All three signal generators (71, 74, 76) are connected with a logic circuit 77 which comprises suitable (AND, OR and NO) gates in an arrangement which insures that a signal from 71, 74 or 76 results in the transmission of a signal to the input of an analog set value function generator 78 whereby such input receives a signal until and unless another of the signal generators 71, 74, 76 transmits a signal to the logic circuit 77. A function generator which can be used at 78 in the control circuit of FIG. 4 is known as POS E2GN (produced by Hauser, Oberschopfheim, Federal Republic Germany). The function generator 78 of the circuit shown in FIG. 4 is followed by a four-quadrant servoamplifier 79 which includes a signal comprising junction 81, an RPM regulator 82 and a servomotor 83 for the DC-motor 27. The amplifier 79 may be of the type known as SV 3510 (also produced and sold by Hauser). The motor 27 is connected with a tachometer generator 84 which transmits signals to the junction 81. The motor 27 and the tachometer generator 84 may constitute a prefabricated unit of the type known as E 67OMGB produced by Bautz, Darmstadt, Federal Republic Germany.

Referring to FIG. 5 in detail, the curve 13*a* represents the movements of the suction head 13, and the curve 19*a* represents the movements of the pusher 19. The time *t* (or the angular movement of control units) is measured along the abscissa and the distance *d* is measured along the ordinate. The lines 71*a*, 74*a*, 76*a* respectively denote the timing of the transmission of signals by signal generators 71, 74 and 76.

FIG. 6 illustrates the characteristic RPM curve 27*a* of the DC-motor 27. The time is measured along the abscissa and the RPM is measured along the ordinate. The lines 71*a*, 74*a*, 76*a* again denote the timing of impulse transmission by the signal generators 71, 74 and 76.

The operation:

When the suction head 13 completes the accumulation of a complete row or layer of articles 9 (i.e., when each of its sockets 12 contains an article), the signal generator 71 transmits a signal to the corresponding input of the logic circuit 77 which, in turn, transmits a signal to the input of the function generator 78. The function generator 78 transmits a signal to the junction 81, and such signal is utilized to start the DC-motor 27. FIG. 6 shows that the acceleration of motor 27 to maximum RPM is practically instantaneous. Actual controlling and regulation of the RPM of the motor 27 is effected by the amplifier 79, and the motor 27 drives the step-down gearing 28 which drives the cams 61. At the same time, the bevel gears 39, 41 drive the cams 43. As indicated by the curve 13*a* of FIG. 5, the cams 61 cooperate with the levers 62 and bifurcated output elements 67 to rapidly move the suction head 13 to one of the two positions (flat top of the curve 13*a*) in which the thus lifted row of articles 9 is ready for transfer into the adjacent tray 2. The acceleration of pusher 19 from the first or retracted position by way of the cams 43, levers 44, lever 49, link 51, lever 53 and link or output element 54 begins even before the suction head 13 reaches a raised position for introduction of the freshly accumulated row of articles 9 into the tray 2 on the conveyor 7. The leading edge of the pusher 19 comes into contact with and begins to shift the row of articles 9 toward and through the mouthpiece 21 as soon as the suction head 13 reaches one of its raised positions.

The pusher 19 thereupon begins its return stroke at a speed which is higher than the speed during forward movement (see the curve 19*a* in FIG. 5). The return movement of suction head 13 to the lower end position in which the sockets 12 can start with accumulation of a fresh row of articles 9 begins as soon as the pusher cannot interfere with return movement of suction head 13 under the action of the cams 61.

When the suction head 13 reassumes its lower end position, the signal generator 74 is actuated by the projection 73 of the cam 72 and transmits a signal to the corresponding input of the logic circuit 77 which, in turn, transmits a signal to the function generator 78. Such signal is used to reduce the RPM of the DC-motor 27 (see FIG. 6) so that the motor 27 can be arrested at the very instant when the projection 73 thereupon causes the signal generator 76 to transmit a signal to the function generator 78 via logic circuit 77. Thus, practically instantaneous stoppage of the motor 27 is possible due to the fact that its speed is reduced in response to a signal from 74 before the signal generator 76 produces a stop signal, i.e., the RPM of the motor 27 is already low when the logic circuit 77 receives a signal from 76. Otherwise stated, the timing of signal which the function generator 78 transmits to the amplifier 79 in response to transmission of a signal from 76 to 77 is such that the RPM of the motor 27 is already sufficiently low to insure stoppage of this motor in an accurately determined angular position. Consequently, when the motor 27 is idle, the angular positions of the cams 43 and 61 are always identical to thus insure that the extent of movement of pusher 19 from first or retracted position into engagement with the rear ends of articles 9 forming a fresh row in the sockets 12 is always the same and also that the suction head 13 invariably assumes one and the same lower end position as soon as the motor 27 is arrested. The function generator 78 is adjustable so that it can select an optimum characteristic RPM curve 27*a* for the motor 27. The amplifier 79 insures that the changes in RPM of the motor 27 invariably satisfy the selected characteristic curve 27*a* as long as the adjustment of the function generator 78 remains unchanged.

A comparison of FIGS. 5 and 6 will indicate that the deceleration of motor 27 (line 74*a*) can begin after the suction head 13 reassumes its lower end position. In other words, the signal generator 74 can be actuated by the projection 73 when the sockets 12 are sufficiently close to the band conveyors 11 to start with accumulation of a fresh row of articles 9. The fact that the output element of the motor 27 continues to rotate after the suction head 13 returns to the lower end position does not result in undesirable displacement of the suction head because the roller followers 63, 64 then track cylindrical portions of the peripheral surfaces of the respective cams 61.

A comparison of FIGS. 5 and 6 further shows that the pusher 19 can reassume its rear end position even before the suction head 13 returns to the lower end position, and also that the deceleration and stoppage of motor 27 can take place while the pusher 19 dwells in the rear end position. The configuration of the cams 43 is such that the deceleration and stoppage of motor 27 do not entail any movements of the pusher 19 from its rear end position.

The feature that the forward movement of pusher 19 is slower than the return movement to rear end position (see the curve 19*a* of FIG. 5) is desirable because it insures that the front edge face of the pusher does not deform or deface the adjacent ends of articles 9 in the sockets 12 when the freshly formed row is to begin its movement through the nozzle 21 and into the adjacent tray 2.

It will be noted that the signal generators 74, 76 are (indirectly) actuated by the mechanical transmission 29, i.e., by the projection 73 of the disk 72 which receives torque from a rotary part of the transmission 29.

The kinematic connection between the cams 43 and 61 is such that the pusher 19 performs two forward and return strokes in response to each complete revolution of the cams 61, and that the suction head 13 moves twice to a raised position (but preferably always to a different raised position) in response to each complete revolution of the cams 61. The start of each upward movement of the suction head 13 from its lower end position precedes the start of the respective forward stroke of the pusher 19. Each downward movement of the suction head 13 to the lower end position is completed before the RPM of the motor 27 is reduced by the signal generator 74. However, it is equally within the purview of the invention to actuate the signal generator 74 before the suction head 13 reaches its lower end position.

FIG. 7 shows the details of the drive 6 for the tray transporting conveyor 7 of FIG. 1. This drive comprises a transmission 86 having a case and an output shaft 87 which extends from the case and carries a sprocket wheel 88 for the endless link chain of the conveyor 7. The output shaft 87 further drives a timer disk 89 having an annulus of projections 91. The distance *a* between the centers of the majority of neighboring projection 91 corresponds to the desired extent of stepwise movement of the chain of the conveyor 7. As stated above, each stepwise movement of the conveyor 7 should result in lowering of a tray 2 thereon through a distance which is slightly less than the diameter of an article 9.

The relatively large distance *b* between two selected projections 91 on the timer disk 89 corresponds to that distance through which the conveyor 7 must lower a freshly filled tray 2A in order to move the next empty tray 2 into an optimum position for reception of the first or lowermost row or layer of articles 9, i.e., in order to move the bottom wall of the empty tray 2 to a position immediately below the discharge end of the mouthpiece 21 shown in FIG. 1.

The input element of the transmission 86 receives torque from a prime mover 92 (e.g., a rotary-field magnet of the type known as DWF 1A 120A/283 produced by Bauer, Esslingen, Federal Republic Germany). This prime mover is a specially designed polyphase asynchronous motor to which voltage is applied even when its output element is idle. The connection between the energy source and the motor 92 includes a motor relay 93 (e.g., a relay known as "Revimat 2000" type R-L produced by Rheinisch-Westfalische Isolatorenwerke, Siegburg, Federal Republic Germany). A control circuit 94 which is associated with the relay 93 includes a contact-free initiator or proximity switch 95 which is adjacent to the path of movement of the pusher 19, a pulse shaper 96 which receives signals from the initiator 95, a second initiator 97 which is adjacent to the path of movement of projections 91 on the timer disk 89, a pulse shaper 98 which receives signals from the initiator 97, a signal storage known as flip-flop 99 whose inputs are connected with the pulse shapers 96, 98 and a further relay 100 which is connected between the output of the flip-flop 99 and the motor relay 93.

The operation of the drive 6 is as follows:

When the pusher 19 performs a working stroke, the initiator 95 is caused to transmit a signal to the pulse shaper 96 which transmits a signal of predetermined shape and duration to the corresponding input of the flip-flop 99. The output of the flip-flop 99 then transmits a signal to the relay 100 which causes the motor relay 93 to change the direction of rotation of the motor 92. The latter drives the input element of the transmission 86 and the output element 87 drives the sprocket wheel 88 and hence the chain of the conveyor 7 in a direction to move the empty tray 2 on the conveyor 7 downwardly. The output element 87 further drives the timer disk 89 which causes an oncoming projection 91 to actuate the initiator 97 which transmits a signal to the pulse shaper 98. The latter transmits a signal of predetermined shape and duration to the erasing input of the flip-flop 99 so that the signal at the output of the flip-flop disappears. The relay 100 causes the motor relay 93 to change the direction of rotation of the motor 92; however, the output element 87 of the transmission 86 does not change the direction of its rotation but simply comes to a full stop because the drive 6 comprises blocking means for holding the output element 87 against rotation in a direction to move a tray 2 or 2A on the conveyor 7 upwardly. Such blocking means may comprise a ratchet wheel on the output element 87 and a pawl which allows the ratchet wheel to rotate in a single direction.

The same sequence of steps is repeated again when the pusher 19 performs the next working stroke. The extent of downward movement of the tray 2 on the chain of the conveyor 7 is increased when the projection 91 which is to actuate the initiator 97 must cover the distance *b*, i.e., when the conveyor 7 is to move the empty tray 2 into register with the nozzle 21 simultaneously with transport of a freshly filled tray 2A onto the conveyor 23 of FIG. 1.

The drive 6 is preferably furnished with two or more timer disks 89 having different spacings *a* and *b* between the respective projections to thus enable the apparatus to fill trays of different sizes and/or to fill trays with articles having larger or smaller diameters.

An advantage of the improved tray filling apparatus is that the mechanical transmission 29 cooperates with the variable-speed motor 27 to enable the apparatus to perform a larger number of cycles per unit of time than heretofore known apparatus wherein the drive for the pusher and/or group forming device comprises a fluid-operated cylinder and piston unit. Moreover, the drive 17 need not employ clutches or analogous parts which are subject to extensive wear and must be inspected, adjusted or replaced at frequent intervals. Also, the drive 17 insures a highly reproducible operation of the apparatus, and the noise level is not higher than in heretofore known apparatus.

The drive 6 for the conveyor 7 is not only simpler and less expensive than heretofore known drives but is also quieter and can stand longer periods of uninterrupted use. Furthermore, such drive is more versatile and is capable of applying greater forces than a fluid-operated drive.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In an apparatus for introducing groups of cigarettes or analogous rod-shaped articles into containers, a combination comprising a group forming device; means for supplying articles to said device; conveyor means for transporting containers past said device; transfer means for moving groups of articles from said device into a container on said conveyor means, said transfer means being arranged to perform translatory movements between first and second positions and to move a group of articles from said device into a container during movement from said first position; and drive means for said transfer means, including a variable-speed prime mover having a rotary output element, a mechanical transmission having input means receiving motion from said output element and output means for imparting translatory movements to said transfer means, and control means for varying the RPM of said output element in accordance with a predetermined pattern, said control means including means for effecting the acceleration of said prime mover from zero speed at a relatively high first rate and the deceleration of said prime mover to zero speed at a relatively low second rate.

2. A combination as defined in claim 1, wherein said transfer means comprises a pusher which is reciprocable between said first and second positions thereof and said transmission further comprises a linkage having a first portion receiving motion from said input means and a second portion coupled to said pusher and constituting said output means, said input means including cam means driven by said output element.

3. A combination as defined in claim 2, wherein said cam means is configurated to effect a movement of said pusher from said first position at a first speed and from said second position at a higher second speed.

4. A combination as defined in claim 1, wherein said prime mover is a DC-motor.

5. A combination as defined in claim 1, wherein said control means comprises an analog set value function generator.

6. A combination as defined in claim 1, wherein said control means further comprises a plurality of signal generators, said means for effecting the acceleration and deceleration of said prime mover being responsive to signals from said signal generators.

7. A combination as defined in claim 6, wherein said signal generators include a first signal generator which initiates the acceleration of said prime mover from zero RPM and means for actuating said first signal generator in response to accumulation of a group of articles by said group forming device.

8. A combination as defined in claim 6, wherein said signal generators include a signal generator which initiates the deceleration of said prime mover and said transmission further includes means for actuating said last mentioned signal generator in a predetermined position of said transfer means.

9. A combination as defined in claim 8, wherein said predetermined position of said first position of said transfer means.

10. A combination as defined in claim 6, wherein said signal generators inlcude a signal generator which initiates the stoppage of said prime mover and said transmission further includes means for actuating said last mentioned signal generator in a predetermined position of said transfer means.

11. A combination as defined in claim 6, wherein said signal generators respectively include a first, a second and a third signal generator for generating signals which respectively cause said acceleration and deceleration effecting means to accelerate, decelerate and arrest said prime mover and said transmission further includes means for actuating said second and third signal generators in a predetermined sequence.

12. A combination as defined in claim 1, wherein said group forming device comprises a suction head which is movable between a first position and at least one second position in which said suction head respectively accepts articles from said supplying means and maintains a fresh group of articles in the path of movement of said transfer means to said second position of said transfer means, said transmission further comprising means for moving said suction head between said positions thereof.

13. A combination as defined in claim 12, wherein said means for moving said suction head comprises cam means driven by said output element and follower means tracking said cam means and operatively connected with said suction head to move said suction head from said first position to said second position while said transfer means dwells in said first position and to move said suction head from said second to said first position after said transfer means returns to said first position.

14. A combination as defined in claim 13, wherein said control means further comprises a plurality of signal generators including a signal generator which is actuatable to generate signals which cause said acceleration and deceleration effecting means to decelerate said prime mover, said transmission further comprising means for actuating said last mentioned signal generator upon completion of movement of said suction head from said first to said second position.

15. A combination as defined in claim 12, wherein said mechanical transmission further comprises first cam means for effecting movements of said transfer means between said first and second positions, second cam means for effecting movements of said suction head between said first position and two different second positions and means for rotating one of said cam means at half the speed of the other of said cam means.

16. A combination as defined in claim 15, wherein said first position is the lower end position of said suction head and said suction head is located at a different distance from said first position in each of said second positions thereof.

17. A combination as defined in claim 1, further comprising second drive means for said conveyor means, said second drive means comprising an electric motor and transmission means interposed between said motor and said conveyor means.

18. A combination as defined in claim 17, wherein said motor is an asynchronous polyphase motor and further comprising a control circuit for said motor, said control circuit including means for starting said motor in dependency on the position of said transfer means and timer means for arresting said motor.

19. A combination as defined in claim 18, wherein said timer means comprises a rotary element driven by said motor.

* * * * *